US007467691B2

(12) United States Patent
Deplazes et al.

(10) Patent No.: US 7,467,691 B2
(45) Date of Patent: Dec. 23, 2008

(54) ELEVATOR INSTALLATION, A METHOD OF OPERATING THIS ELEVATOR INSTALLATION, AND METHOD OF MODERNIZING AN ELEVATOR INSTALLATION

(75) Inventors: Romeo Deplazes, Oberrueti (CH); Lian-Choo Lim, Zug (CH)

(73) Assignee: Inventio AG, Hergiswil (CH)

( * ) Notice: Subject to any disclaimer, the term of this patent is extended or adjusted under 35 U.S.C. 154(b) by 501 days.

(21) Appl. No.: 10/864,131

(22) Filed: Jun. 9, 2004

(65) Prior Publication Data

US 2004/0256179 A1 Dec. 23, 2004

(30) Foreign Application Priority Data

Jun. 18, 2003 (EP) ..... 03405439

(51) Int. Cl.
*B66B 9/00* (2006.01)

(52) U.S. Cl. ..... 187/249; 187/382; 187/383; 187/313

(58) Field of Classification Search ..... 187/249, 187/382, 383, 313
See application file for complete search history.

(56) References Cited

U.S. PATENT DOCUMENTS 5,419,414 A * 5/1995 Sakita ..... 187/391
5,433,293 A * 7/1995 Sager ..... 187/249
5,566,784 A * 10/1996 Rennetaud ..... 187/249
5,663,538 A * 9/1997 Sakita ..... 187/382
5,984,052 A * 11/1999 Cloux et al. ..... 187/404
6,336,523 B1 * 1/2002 Ozeki et al. ..... 187/391
6,854,564 B2 * 2/2005 Reuter et al. ..... 187/249
7,032,715 B2 * 4/2006 Smith et al. ..... 187/380
7,032,716 B2 * 4/2006 Meyle et al. ..... 187/382
2001/0018996 A1 * 9/2001 Itoh et al. ..... 187/249
2004/0129502 A1 * 7/2004 Hikita ..... 187/383
2004/0216959 A1 * 11/2004 Ach ..... 187/264
2004/0216960 A1 * 11/2004 Kocher et al. ..... 187/293
2005/0082121 A1 * 4/2005 Deplazes ..... 187/313

FOREIGN PATENT DOCUMENTS

EP 1 329 412 A 7/2003
WO WO 02 30801 A 4/2002
WO WO 02 072460 A 9/2002

* cited by examiner

*Primary Examiner*—Patrick H Mackey
*Assistant Examiner*—Terrell H Matthews
(74) *Attorney, Agent, or Firm*—Klaus P. Stoffel; Wolff & Samson PC

(57) ABSTRACT

An elevator installation for conveying persons/goods, a method for operating the elevator installation and to a method for modernizing an elevator installation. The elevator installation includes at least two cages arranged one above the other in a vertical travel direction, and a drive per cage for moving the cages. The cage and the drive are connected by way of a conveying member. A counterweight for weight compensation of each cage. At least one cage guide rail is provided for guiding the cages, and at least a pair of counterweight guide rails are provided for guiding the counterweights. The drives are arranged near different first walls in the shaft.

24 Claims, 5 Drawing Sheets

ELEVATOR INSTALLATION, A METHOD OF OPERATING THIS ELEVATOR INSTALLATION, AND METHOD OF MODERNIZING AN ELEVATOR INSTALLATION

BACKGROUND OF THE INVENTION

The present invention relates to an elevator installation for conveying persons/goods, a method of operating the elevator installation and a method of modernizing an elevator installation.

In the case of new installations of elevators, the desire exists for space-saving elevator installations which are simple to install. This has the consequence that the elevator installations no longer require separate engine rooms, but fit in simply conceived, standardized parallelepipedonal shafts. The costs in planning and construction of the building are thus reduced and the usable building space increases.

In the case of modernizations of elevator installations, the desire exists for an increase in the conveying capacity of the elevator installations. This increase in performance, however, is to be realized with small constructional changes to the building in order to keep down the costs of modernization.

U.S. Pat. No. 5,419,414 shows an elevator installation with several cages arranged one above another in a shaft. The cages are moved independently of one another. Each cage has a drive and a counterweight. The cages are connected with counterweights by way of cables as conveying means. In order that all cages can serve the same storeys of the building, diversion spaces are provided above and below the storeys served by the cages. Thus, first cages can move in these diversion spaces and further cages can move to the place in the shaft of the first cages. The drives are mounted above the shaft. This elevator installation achieves an increase in conveying performance by increasing the number of cages in the shaft.

A disadvantage of the teaching according to U.S. Pat. No. 5,419,414 is that the mounting of several drives in an engine room above the shaft is costly. Such an engine room is often difficult with respect to access. For example, the drives have to be broken down for transport into the engine room, so that they can pass through passageways and doors, which passageways and doors lie on the route to the engine room. In addition, it is disadvantageous that the presence of an engine room above the shaft as well as the provision of passing places in the shaft keeps down the potential usable building space. In particular, storeys which are disposed at the level of the passing spaces might not be served by the cages. It follows from these disadvantages that new installation and modernization of such an elevator installation causes high costs.

SUMMARY OF THE INVENTION

It is an object of the present invention to provide an elevator installation which is simple and economic to install and produces a high conveying performance and by which an existing elevator installation is simple and economic to modernize. This lift installation shall be compatible with existing and proven methods of elevator construction.

The invention fulfils these objects by an elevator installation in which not one, but at least two cages arranged one above the other move in a vertical travel direction. The cages are moved by a drive for each cage along at least one cage guide rail. The drives are connected with the cages by way of conveying means. According to the invention, the drives are arranged near different first walls in the shaft.

The drives are thus arranged in the shaft, for example in the shaft head. In this manner the engine room can be omitted, whereby the building space is utilized in optimum manner and at the same time a significant increase in conveying capacity is effected through the use of at least two cages in one and the same shaft. A mounting of several drives in the shaft head is substantially simpler to manage than outside the shaft in the engine room. Thus, the components of the drive can be transported through the shaft into the shaft head.

Advantageously, a counterweight is provided for each cage. In another embodiment, the drives are arranged in the shaft substantially above the counterweights. A further embodiment provides that the drives are arranged in the shaft at substantially the same height. Advantageously each drive of a cage is arranged in the shaft above the counterweight of this cage near the first walls. In still another embodiment at least one counterweight guide rail is provided for each counterweight. The drives can be supported on ends of the guide rails for the cage and the counterweight. Another embodiment provides fixing points for the conveying means. The fixing points are fastened to the guide rails for the cage or the counterweight. Advantageously electrical means for the elevator are supported at least partly on the guide rails for the cage or the counterweight. The drives and/or the electric means can be carried directly or indirectly by way of horizontal beams from the guide rails for the cage or the counterweight, or the conveying means fixing points can be fastened directly or indirectly by way of horizontal beams to the guide rails for the cage or the counterweight.

In this manner otherwise unusable shaft space above the counterweights is utilized to a high degree for mounting the drives and the electrical means. In addition, the guide rails for the cage or the counterweight or the horizontal beams form a self-supporting structure for carrying the drives, the cages, the counterweight and the electrical means as well as for attaching the conveying means fixing points. This structure is substantially symmetrical and in mirror image with respect to a diagonal of the shaft cross-section. Thus, no significant interfaces relative to the building are necessary, which simplifies new installation and mounting of the lift plant.

Access to the cages is effected by way of storey doors arranged at second walls in the shaft, which second walls are different from the first walls. Advantageously guide rails, counterweights and drives are mounted near two first walls, whereas the storey doors are formed at two second walls.

In this manner not only the shaft space, but also the walls of the shaft and thus the access to the elevator installation are optimally utilized. For example, the guide rails, the counterweights and the drives are mounted near two first walls in the shaft, while the access to the elevator installation is effected by way of storey doors formed at two second walls.

Advantageously, at least one passing space for at least one cage is provided, which passing space is arranged in the shaft head and/or in the shaft base. In the case of modernization, an existing engine room is converted to a passing space for at least one cage.

Through provision of at least one diversion space above or below the served storeys of the building a first cage can be moved into this passing space. This first cage now no longer occupies any space in the shaft region of the served storey and a further cage can be moved in this space. Thus, not only the first cage, but also a further cage can serve the storey above or below the diversion space, which leads to an increase in conveying performance particularly in stacked operation. Due to the fact that in the case of modernization an existing engine room is converted to a diversion space, a new utilization of building space takes place for further increase in conveying performance.

Other features and advantages of the present invention will become apparent from the following description of the invention which refers to the accompanying drawings.

DETAILED DESCRIPTION OF THE INVENTION

Figure 1:
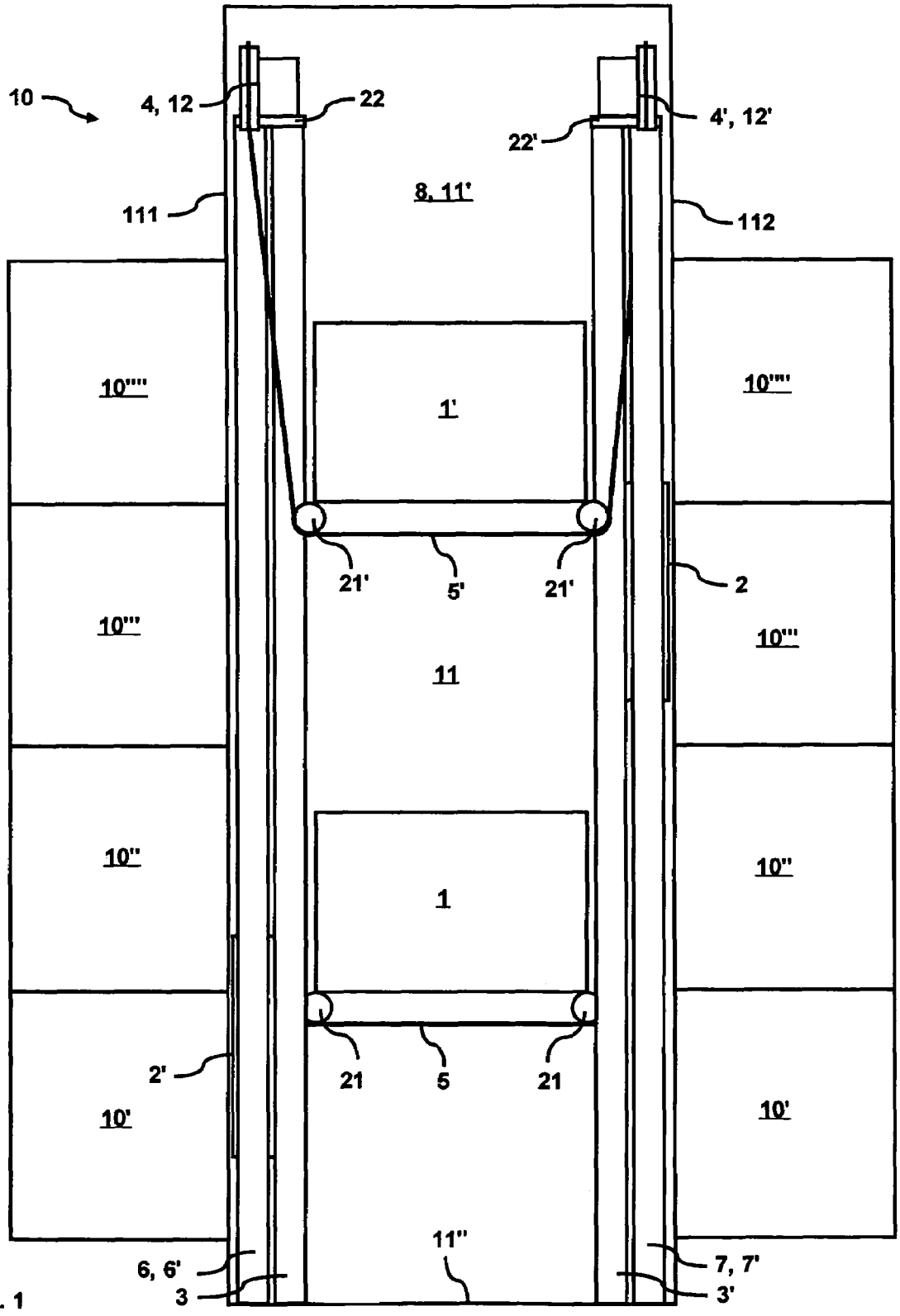
FIG. 1 shows a schematic side view of part of a first embodiment of an elevator installation with two cages slung 2:1 in a shaft.
Figure 2:
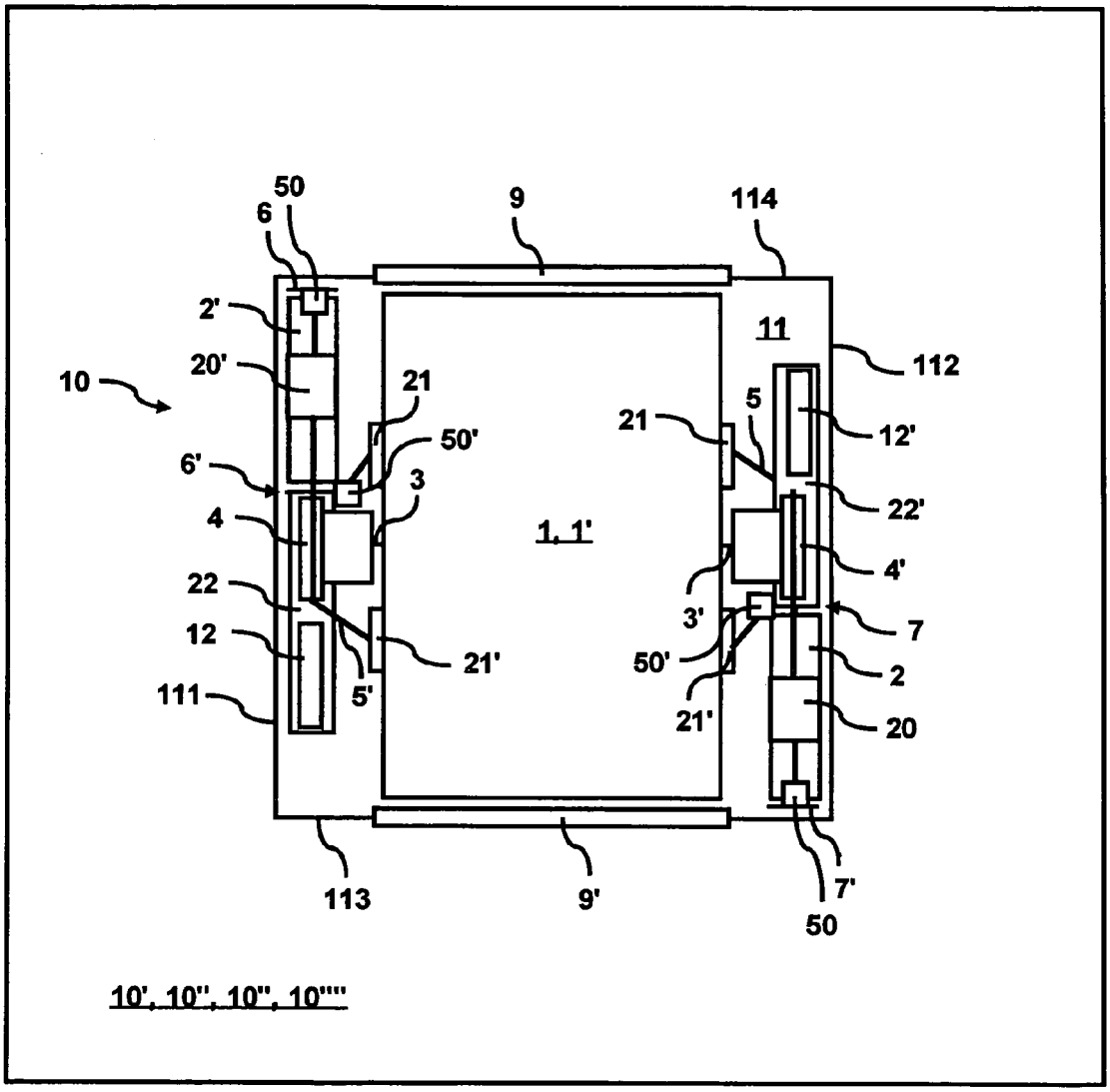
FIG. 2 shows a schematic plan view of a part of the first embodiment of an elevator installation according to FIG. 1.

FIGS. 1 to 4 show an embodiment of an elevator installation 10 for conveying persons/goods between storeys 10, 10', 10", 10'" of a building. The elevator installation 10 is advantageously installed in a shaft 11 of the building. For example, the shaft has a rectangular cross-section with a height which extends substantially completely through the building. The shaft 11 has different walls 111, 112, 113, 114, a shaft head 11' and a shaft base 11". The different walls 111, 112, 113, 114 are bounded by edges, which are, for example, rectangular and extend through the length of the shaft 11. The shaft can also have a different cross-sectional shape, such as a hexagon with six different walls; it can also have a circular cross-section with several different wall regions. Different wall regions are bounded by angular segments, for example a circular shaft consists of four regions each of 90° or of six wall regions each of 60°, etc. The shaft 11 can obviously also extend only partly through the building. The elevator installation 10 can be installed in shaft-free manner in an inner courtyard of a building or also outside a building. The expert skilled in the art has here numerous possibilities of variation.

The elevator installation 10 comprises at least two cages 1, 1', which cages are moved in a vertical travel direction one above the other in the shaft 11. There is to be understood by the expression 'movable one above the other' not a travelling past of the respective other cage, i.e. a lower cage 1 always remains below an upper cage 1'. The cages 1, 1' are conventional and proven elevator cages, which are moved by way of guide shoes at at least one cage guide rail 3, 3'. Advantageously, the two cages 1, 1' use two cage guide rails 3, 3' near different first walls 111, 112. Advantageously a first cage guide rail 3 is arranged near a first wall 111 and a second cage guide rail 3' is arranged near a further first wall 112. With knowledge of the present invention, obviously also more than two cages 1, 1' can travel in this manner in a shaft 11 along cage guide rails 3, 3'. In addition, the expert can provide a single cage guide rail instead of a pair of cage guide rails.

Advantageously, the elevator installation 10 has, per cage 1, 1', a drive 4, 4'. A first drive 4 drives the upper cage 1' and a second drive 4' drives the lower cage 1. The lift drive 4, 4' is, for example, a drive pulley drive. With knowledge of the present invention all known and proven drives can be used. For example, gearless drives or drives with gears can be used. In addition, drives with permanent magnets, with a synchronous motor or an asynchronous motor can also be used.

Advantageously, the elevator installation 10 has a counterweight 2, 2' for each cage 1, 1'. A drive pulley drive connects a cage 1, 1' with a counterweight 2, 2' by way of at least one conveying means 5, 5' and drives these. A first conveying means 5 connects the lower cage 1 with an upper counterweight 2 and a second conveying means 5' connects the upper cage 1' with a lower counterweight 2'. Advantageously, the counterweights 2, 2' are moved near the cages 1, 1'. For example, the cages 1, 1' are moved in the shaft center and the counterweights 2, 2' are moved at the shaft edge near the first walls 111, 112. The conveying means 5, 5' can have any desired form and it can also be of any desired materials. For example, the conveying means 5, 5' can be a round cable, a double cable or a belt. For example, the conveying means 5, 5' can be at least partly of steel or aramide fibers.

In the forms of embodiment of an elevator installation according to FIGS. 1 to 4, the counterweights 2, 2' are moved adjacent to one another near the cages 1, 1'. There is to be understood by the expression 'movable adjacent to one another' a traveling past of the counterweights 2, 2', i.e. each of the counterweights 2, 2' uses at least one counterweight guide rail 6, 6', 7, 7'. Advantageously, each counterweight 2, 2' uses a pair of counterweight guide rails 6, 6', 7, 7'. The upper counterweight 2 has a first pair of counterweight guide rails 6, 6', which pair is mounted near a first wall 111, and the lower counterweight 2' has a second pair of counterweight guide rails 7, 7', which pair is mounted near a first wall 112. With knowledge of the present invention it is obviously also possible for the expert to undertake variations of this embodiment. Thus, the counterweights do not necessarily have to be moved adjacent to one another, but can also be moved one above the other similarly to the cages. The advantage of the travelling one above the other resides in the fact that only one pair of guide rails is necessary for the counterweights. The expert can obviously also use only a single counterweight guide rail for both counterweights.

The cages 1, 1' or the counterweights 2, 2' can travel in 1:2 slinging or in 1:1 slinging. In the case of 1:2 slinging the conveying means 5, 5' are connected with the cage 1, 1' or with the counterweight 2, 2' by way of at least one deflecting roller 21, 21', 20, 20'. In the case of 1:1 slinging the conveying means 5, 5' is connected at one end directly with the cage 1, 1' or the counterweight 2, 2'. In the embodiment of an elevator installation 10 according to FIGS. 1 and 2, the cages and the counterweights have 1:2 slinging. Also, two deflecting rollers 21, 21' are arranged as bottom blocks below each cage 1, 1'. For example, a deflecting roller 20, 20' is arranged above each counterweight 2, 2'. Advantageously, the two ends of the conveying means 5, 5' are fastened as conveying means fixing points 50, 50' in the shaft head 11' to the cage guide rails 3, 3' or to the counterweight guide rails 6, 6', 7, 7'. There is to be understood by the term 'cage guide rails or counterweight guide rails' a combination of cage guide rails 3, 3' and/or of counterweight guide rails 6, 6', 7, 7'. The conveying means 5, 5' extend from a first conveying means fixing point 50 at the counterweight guide rails 6, 7' by way of the counterweight deflecting roller 20, 20' to the drive pulley of the drive 4, 4', and from there by way of the cage deflecting rollers 21, 21' to a second conveying means fixing point 50' at the counterweight guide rails 6', 7. The conveying means fixing points 50, 50' are thus fastened to guide rails near two different first walls 111, 112 in the shaft 11.

Figure 3:
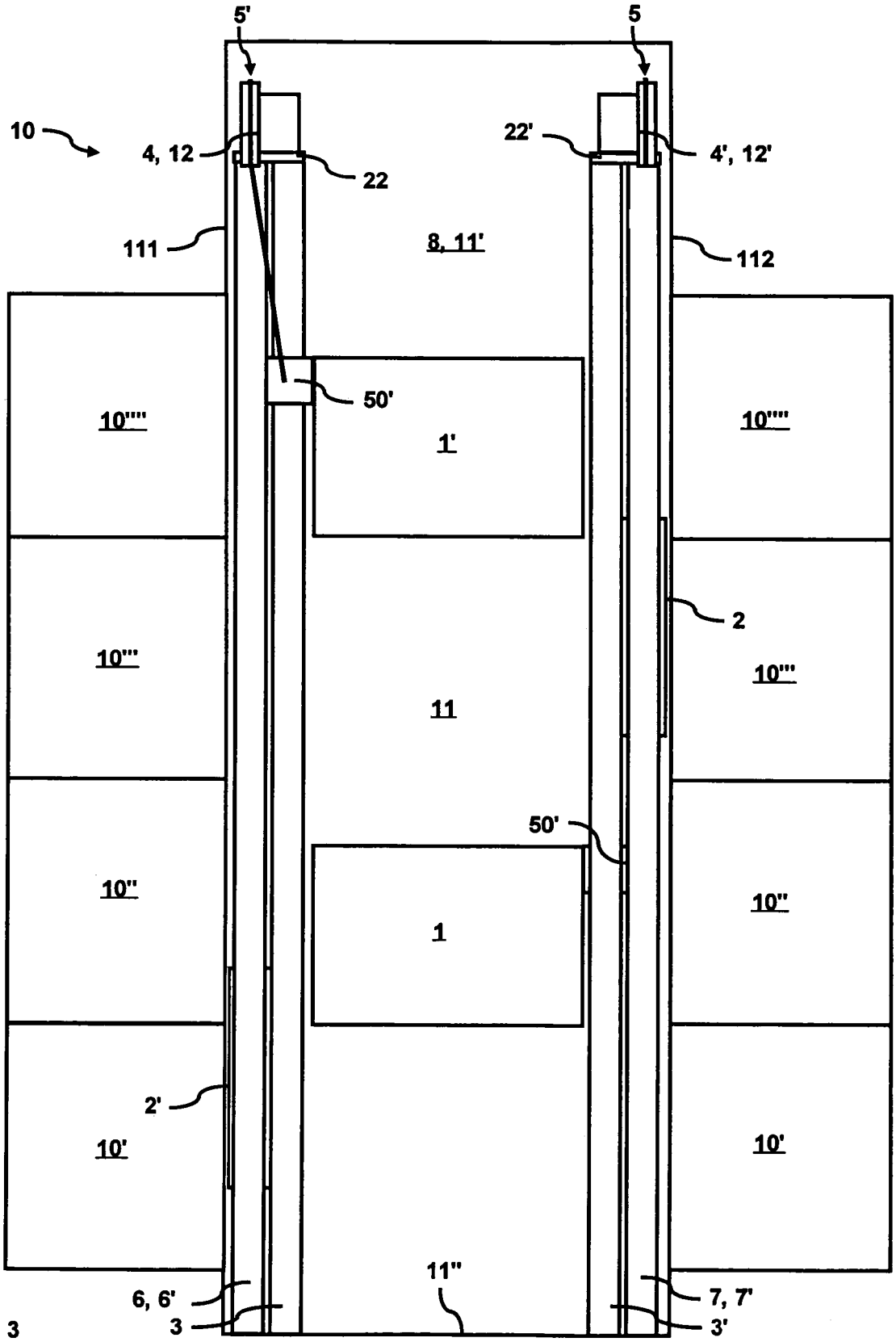
FIG. 3 shows a schematic side elevation of a part of a second embodiment of an elevator installation with two cages slung 1:1 in a shaft.
Figure 4:
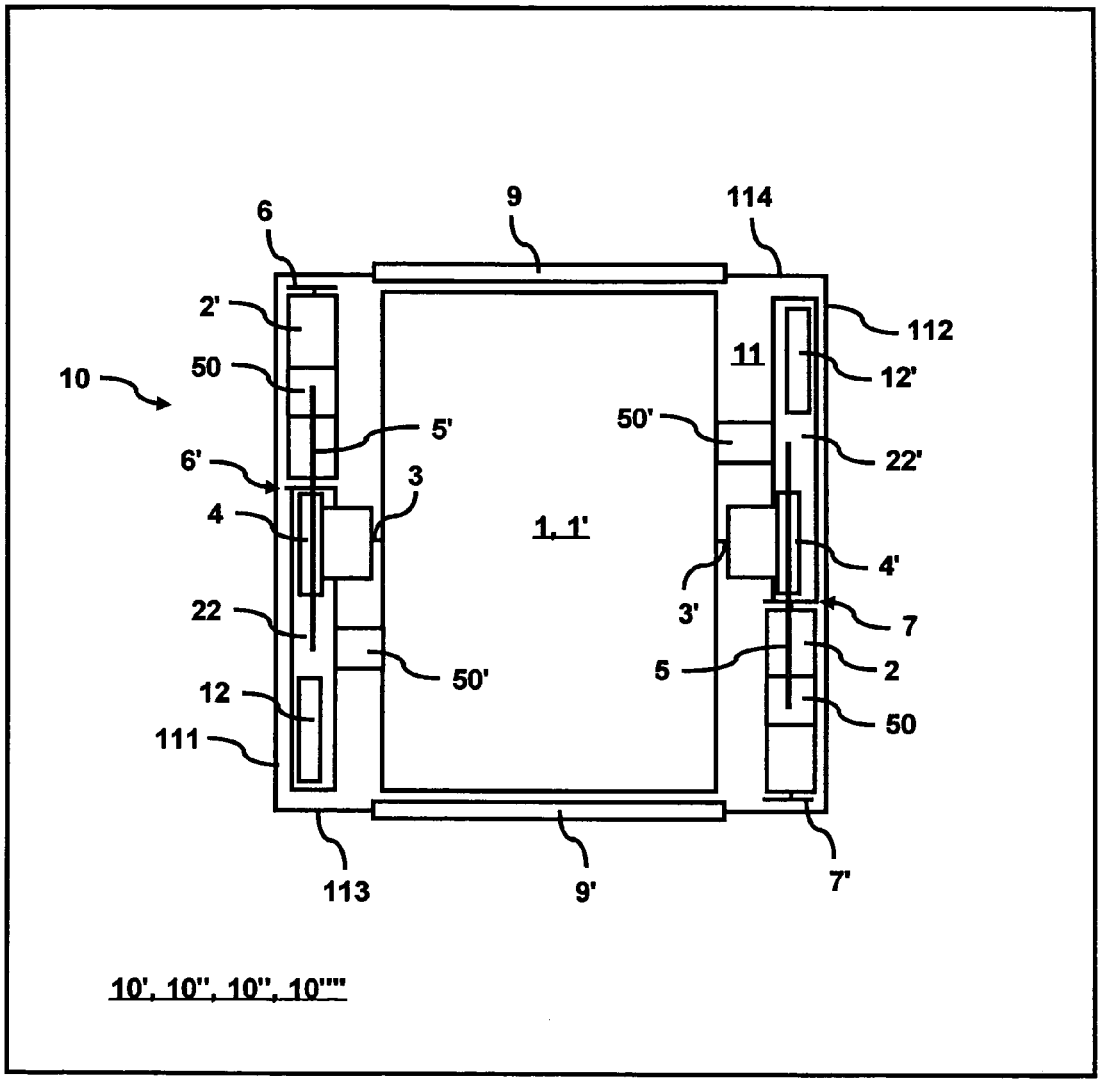
FIG. 4 shows a schematic plan view of part of the second embodiment of an elevator installation according to FIG. 3.

In the embodiment of an elevator installation 10 according to FIGS. 3 and 4, the cages and the counterweights have 1:1 slinging. The conveying means 5, 5' extends from a first conveying means fixing point 50 at the counterweight 2, 2' to the drive pulley of the drive 4, 4' and from there to a second conveying means fixing point 50' at the cage 1, 1'. The advantage of 1:2 slinging relative to 1:1 slinging is that comparatively lower performance and thus smaller and less expensive drives 4, 4' can be used. In the case of 1:2 slinging a conveying means 5, 5' of twice the length is needed by comparison with 1:1 slinging and, in addition, several deflecting rollers are required. With knowledge of the present invention obviously also other slingings such as 1:4 and combinations of 1:1 and 1:2, etc., can be realized.

Advantageously the drives 4, 4' are mounted near a first wall 111, 112. By the expression 'near a first wall' there is understood a mounting of the drives 4, 4' on the cage guide rails 3, 3' or at the counterweight guide rails 6, 6', 7, 7', which guide rails are mounted near a first wall 111, 112, i.e. which guide rails are in principle free-standing in the shaft, but, for example, are fixed by way of clips to the first walls 111, 112. There is to be understood by the term 'free-standing in principle' an introduction of substantially all forces, which arise in operation of the elevator installation 10', by way of the cage guide rails 3, 3' or the counterweight guide rails 6, 6', 7, 7' into the shaft base 11. There is to be understood by the expression 'substantially all forces arising in operation of the elevator installation 10' on the one hand the forces which arise in normal operation, but also such forces which arise in the case of emergency, for example on engagement of the safety braking advice, in the case of buffer travels of the cage or the counterweights, etc.

Advantageously, the drives 4, 4' are supported on the cage guide rails 3, 3' or at the counterweight guide rails 6, 6', 7, 7'. Further advantageously, the drives 4, 4' are arranged in the shaft 11 at substantially the same height. Advantageously, the drives 4, 4' are arranged substantially above the counterweights 2, 2'. Electrical means 12,12' for operating the elevator installation 10 can be supported at least partly on the cage guide rails 3, 3' or at the counterweight guide rails 6, 6', 7, 7'. Such electrical means 12, 12' comprise, for example, a transformer for control of the drives 4, 4' or an electronic system for special operation of the elevator installation 10, for example in the case of emergency for evacuation or in the case of modification tasks.

The cage guide rails 3, 3' or the counterweight guide rails 6, 6', 7, 7' thus form a self-supporting structure for carrying the cages 1, 1' and the counterweights 2, 2' as well as for carrying elevator components such as the drives 4, 4' and/or the electrical means 12, 12' as well as for fastening the conveying means fixing points 50, 50'. This self-supporting structure has minimum interfaces, such as the fixing clips of the guide rails, relative to the building. The self-supporting structure is constructed substantially symmetrically and in mirror image with respect to a diagonal in the shaft cross-section. In the embodiments of the elevator installation 10 according to FIGS. 2 and 4, these diagonals extend from the corner of the walls 111 and 113 to the corner of the walls 112 and 114. Advantageously the self-supporting structure has, apart from the cage guide rails 3, 3' and the counterweight guide rails 6, 6', 7, 7', also horizontal beams 22, 22'. A first horizontal beam 22 is arranged near a first wall 111 above the first cage guide rail 3 or the first pair of counterweight guide rails 6, 6'. A second horizontal beam 22' is arranged near a first wall 112 above the second cage guide rail 3' or the second pair of counterweight guide rails 7, 7'. Advantageously, the drives 4, 4' and/or the electrical means 12, 12' and/or the conveying means fixing points 50, 50' are arranged on the horizontal beams 22, 22', which are mounted at upper ends of the cage guide rail 3, 3' or the counterweight guide rails 6, 6', 7, 7'. With knowledge of the present invention the expert can obviously realize numerous variants of the arrangement of elevator components and the design of the self-supporting structure. Thus, the expert can also mount other elevator components, which are not described in more detail, such as speed limiters, position marks, etc., at the self-supporting structure.

Advantageously, access to the cages 1, 1' is effected by way of storey doors 9, 9', which storey doors 9, 9' are arranged in the shaft 11 at second walls 113, 114 different from the first walls 111, 112. In the embodiments of an elevator installation 10 according to FIGS. 1 to 4, the cage guide rails 3, 3' or the counterweight guide rails 6, 6', 7, 7' together with the counterweights 2, 2' and the drives 4, 4' are mounted near two first walls 111, 112, while the access to the cages 1, 1' is effected by way of the storey doors 9, 9' at the two second walls 113, 114.

Figure 5A:
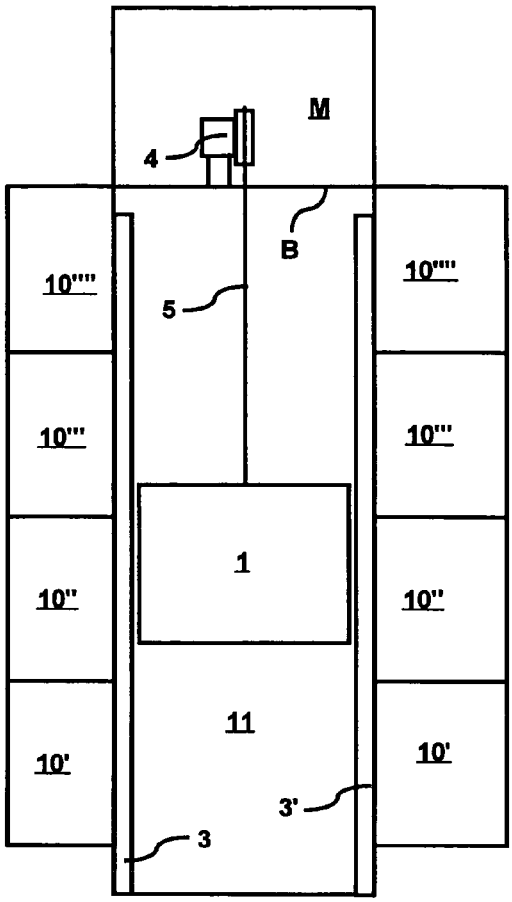
FIG. 5 shows two schematic side elevations of a part of an embodiment of a modernized elevator installation, in which an existing engine room is converted to a passing space.
Figure 5B:
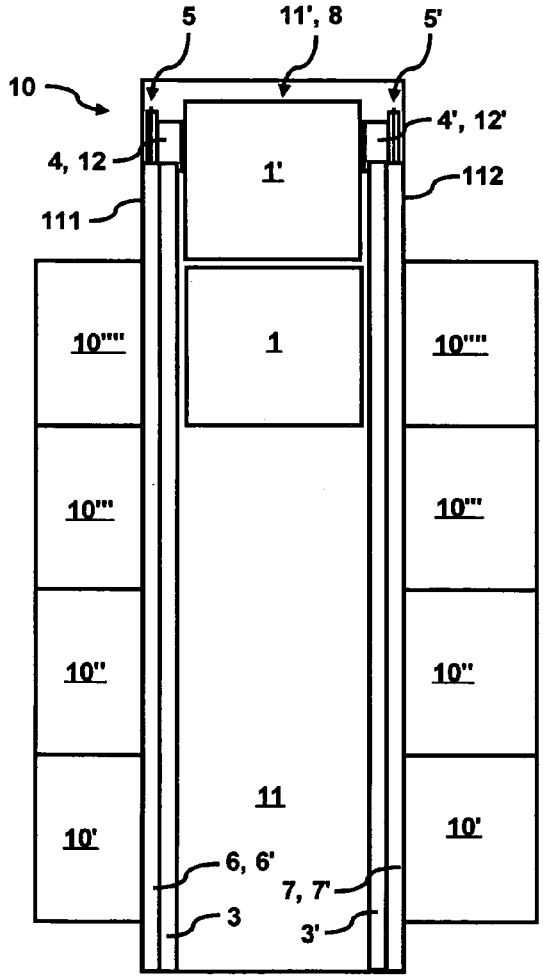

FIGS. 5*a* and 5*b* show an embodiment of a modernized elevator installation 10 in which an existing engine room M is converted to at least one diversion space 8. FIG. 5*a* shows the elevator installation before modernization, where an engine room M is arranged above the shaft 11, and FIG. 5*b* shows the elevator installation 10 after the modernization, wherein a diversion space 8 for at least one cage 1, 1' is provided in the shaft head 11'. The embodiment of a modernized elevator installation 10 according to FIG. 5*b* corresponds with that according to FIGS. 1 to 4, so that reference is made to these parts of description.

For reasons of clarity, FIGS. 5*a* and 5*b* are in strongly schematic form. Thus, the counterweights which are present are not drawn. The important steps in modernization of the elevator installation consist in removal of the engine room floor B and in mounting cage guide rails 3, 3' or counterweight guide rails 6, 6', 7, 7' near first walls 111, 112, which guide rails extend into building space previously used for the engine room M and carry drives 4, 4' or electrical means 12, 12'. This building space in the shaft head 11' is newly used as a diversion space 8. The upper cage 1' is thus moved into this diversion space 8 to such an extent that not only the upper cage 1', but also the lower cage 1 serve the uppermost storey 10"". With knowledge of the present invention the expert can obviously also realize such a diversion space 8 in place of an engine room disposed below the shaft 11. Obviously the expert with knowledge of the present invention can also realize two and more such diversion spaces in the shaft head 11' and/or in the shaft base 11".

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A machineroomless elevator installation, comprising:

a common shaft having two opposed first walls;

at least two cages arranged one above the other in a vertical travel direction in the shaft, the at least two cages being movable independently of each other along the common shaft;

at least two drives, each of said drives being individually assigned to one of the cages; and conveying means for connecting each of the drives and the assigned cage, the at least two drives being arranged opposed to one another near the two opposed first walls in the shaft.

2. An elevator installation according to claim 1, and further comprising at least two counterweights, each of said counterweights being assigned, and connected by the conveying means, to one of the cages, and at least one counterweight guide rail provided for each counterweight, the counterweights and the counterweight guide rails being arranged opposed to each other near the two opposed first walls in the shaft.

3. An elevator installation according to claim 1, and further comprising a common cage guide rail for guiding the cages, wherein said common cage guide rail guides both of the at least two cages.

4. An elevator installation according to claim 3, wherein a pair of common cage guide rails guides the cages and said pair of common cage guide rails guides both of the at least two cages, each of the two cage guide rails forming the pair of cage guide rails is arranged opposite to the other near the two opposed first walls in the shaft.

5. An elevator installation according to claim 4, wherein the drives are supported on said pair of cage guide rails and two pairs of counterweight guide rails.

6. An elevator installation according to claim 3, wherein the drives are arranged in the shaft at substantially a common height.

7. An elevator installation according to claim 2, further comprising a common cage guide rail for guiding the cages, wherein said common cage guide rail guides both of the at least two cages, wherein each of the drives is supported on the cage guide rail or the case guide rails or the counterweight guide rails or on one of the cage guide rails and one of the pairs of counterweight guide rails.

8. An elevator installation according to claim 6, wherein each of the drives is supported on the cage guide rail or the cage guide rails or the counterweight guide rails or on one of the cage guide rails and one of the pairs of counterweight guide rails.

9. An elevator installation according to claim 6, wherein each drive is arranged substantially above the counterweight of a corresponding cage and the drives are supported on ends of the cage guide rail or the cage guide rails or the counterweight guide rails or on one of the cage guide rails and one of the pairs of counterweight guide rails.

10. An elevator installation according to claim 7, wherein the drives are supported on ends of the cage guide rail or the cage guide rails or counterweight guide rails or on one of the cage guide rails and one of the pairs of counterweight guide rails.

11. An elevator installation according to claim 2, and further comprising electrical apparatus supported on the cage guide rail or the cage guide rails or the counterweight guide rails or on one of the cage guide rails and one of the pairs of counterweight guide rails.

12. An elevator installation according to claim 2, and further comprising fixing points for the conveying means fastened to the cage guide rail or the cage guide rails or the counterweight guide rails or on one of the cage guide rails and one of the pairs of counterweight guide rails.

13. An elevator installation according to claim 2, and further comprising horizontal beams connected to the cage guide rail or the cage guide rails or the counterweight guide rails or on one of the cage guide rails and one of the pairs of counterweight guide rails so as to form a self-supporting structure.

14. An elevator installation according, to claim 1, and further comprising storey doors arranged at second walls in the shaft different from the first walls, the storey doors being arranged to permit access to the cages.

15. An elevator installation according to claim 1, wherein the cages have 1:1 slinging.

16. An elevator installation according to claim 1, wherein the cages have 1:2 slinging.

17. An elevator installation according to claim 1, wherein at least one diversion space for at least one cage is arranged in the shaft headroom or in the shaft pit.

18. An elevator installation according to claim 1, wherein at least one diversion space for at least one cage is arranged in the shaft headroom and in the shaft pit.

19. A method of operating a machineroomless elevator installation with at least two independently movable cages arranged one above the other in a vertical travel direction in a common shaft having two opposed first walls, at least two drives, each of said drives being individually assigned to a respective one of the cages, and conveying means for connecting each drive to the assigned cage, the method comprising the steps of:

arranging the at least two drives opposed to one another near the two opposed first walls in the shaft; and arranging storey doors for entering the cages at second walls in the shaft different from the first walls.

20. A method of modernizing an elevator installation, comprising the steps of:

mounting at least two independently movable cages arranged one above the other in a vertical travel direction in a common shaft;

providing at least two drives, each drive being assigned to a respective one of the cages, and conveying means for connecting each of the drives with its respective one of the cages; and arranging the at least two drives opposite one another in the shaft near two opposed first walls.

21. A method according to claim 20, further comprising arranging at least one diversion space for at least one cage in the shaft headroom or in the shaft pit.

22. A method according to claim 20, further comprising arranging at least one diversion space for at least one cage in the shaft headroom and in the shaft pit.

23. A method according to claim 21, including converting an existing engine room into at least one diversion space for at least one cage.

24. A machineroomless elevator installation, comprising:

a common shaft having two opposed first walls;

at least two cages arranged one above the other in a vertical travel direction in the shaft, the at least two cages being movable independently of each other along the common shaft;

at least two drives, each of said drives being individually assigned to one of the cages;

conveying means for connecting each of the drives and the assigned cage, the at least two drives being arranged opposed to one another near the two opposed first walls in the shaft;

at least two counterweights, each of said counterweights being assigned, and connected by the conveying means, to one of the cages;

at least one counterweight guide rail provided for each counterweight, the counterweights and the counterweight guide rails being arranged opposed to each other near the two opposed first walls in the shaft; and a common cage guide rail for guiding the cages, wherein said common cage guide rail guides both of the at least two cages.

* * * * *